US005349702A

United States Patent [19]

Runckel

[11] Patent Number: 5,349,702

[45] Date of Patent: Sep. 27, 1994

[54] LEAK-PROOF CAP WITH IMPROVED SEAL CONSTRUCTION

[75] Inventor: John L. Runckel, Lake Oswego, Oreg.

[73] Assignee: John L. Runckel, Trust, Portland, Oreg. ; John Runckel and Markie W. Runckel, Cotrustees

[21] Appl. No.: 6,472

[22] Filed: Jan. 21, 1993

[51] Int. Cl.[5] ..... A42B 1/12

[52] U.S. Cl. ..... 2/68; 2/171; 2/DIG. 10

[58] Field of Search ..... 2/68, DIG. 3, DIG. 10, 2/413, 423, 171, 171.2, 175.4, 425, 209, 200.3; 128/DIG. 20

[56] References Cited

U.S. PATENT DOCUMENTS

| | | | |
|---|---|---|---|
| 1,501,409 | 7/1924 | Logan | 2/68 |
| 1,746,477 | 2/1930 | Howland | 2/68 |
| 1,898,954 | 2/1933 | Gustafson | 2/68 |
| 2,033,802 | 3/1936 | Abram | 2/68 |
| 2,063,232 | 12/1936 | Davies | 2/68 |
| 2,072,483 | 3/1937 | Naundorf | 2/68 |
| 3,026,526 | 3/1962 | Montrose | 2/68 |
| 3,108,283 | 10/1963 | Gasaway | 2/68 |
| 3,113,319 | 12/1963 | Vail | 2/68 |
| 3,403,406 | 10/1968 | Weissberg | 2/68 |
| 3,447,164 | 6/1969 | Greenhouse | 2/68 |
| 3,866,243 | 2/1975 | Morgan | 2/3 R |
| 4,281,417 | 8/1981 | Valentine | 2/68 |
| 4,802,245 | 2/1989 | Miano | 2/68 |
| 5,083,320 | 1/1992 | Halstead | 2/413 |

FOREIGN PATENT DOCUMENTS

| | | | |
|---|---|---|---|
| 72971 | 8/1951 | Denmark | 2/68 |
| 146577 | 3/1936 | Fed. Rep. of Germany | 2/68 |
| 2442591 | 3/1976 | Fed. Rep. of Germany | 2/68 |
| 3335844 | 4/1985 | Fed. Rep. of Germany | 2/68 |
| 630897 | 12/1927 | France | 2/68 |

*Primary Examiner*—Clifford D. Crowder
*Assistant Examiner*—Amy B. Vanatta
*Attorney, Agent, or Firm*—Kolisch, Hartwell, Dickinson, McCormack & Heuser

[57] ABSTRACT

This invention relates to a leak-proof swimming cap with sealing structure for affecting a water-tight seal around the margin of the cap. More particularly, this invention relates to a swimming cap with sealing structure positioned generally below the wearer's ears, adjacent the mandible, extending upwardly and behind the ears, and over the mastoid process. The sealing structure comprises a cushion structure and an inflatable bladder structure disposed between the cap and the cushion structure.

6 Claims, 1 Drawing Sheet

LEAK-PROOF CAP WITH IMPROVED SEAL CONSTRUCTION

BACKGROUND AND SUMMARY OF THE INVENTION

This invention relates to leak-proof caps, as exemplified by swimming caps, shower caps and bathing caps.

The problem with prior known caps, such as swimming caps, is that they are not entirely water-tight along the length of the margin of the cap that fits against the head. This is because of the irregular shape of the human head and neck, and due to changes in shape caused by the tensing and relaxing of muscles during use of the cap. More specifically, swimming caps have not created a water-tight seal against the head in regions of the head located below and directly adjacent the ears of the head. Furthermore, problems have arisen in obtaining an adequate seal in regions extending across the nape of the neck because of the flexing of muscles in this area during swimming. For example, during the crawl stroke, the neck muscles alternately flex and relax as the head is turned from side to side.

It is therefore an object of this invention, to provide a new and improved leakproof cap featuring a seal in the cap which addresses the herein above discussed problems.

More specifically, an object of the invention is to provide a new leak-proof cap which features a seal composed of foam material and a bladder specially shaped, so as to provide a seal in regions below and directly adjacent the rear of the wearer's ears.

A related object is to provide such a cap which has sealing structure for sealing an edge margin of the cap to the head of a wearer, where the sealing structure extends across the nape of the neck and to regions directly adjacent and below the wearer's ears, wherein these regions are enlarged in such a manner as to produce an improved watertight seal.

In the preferred embodiment, the invention comprises a swimming cap manufactured of a flexible resilient material. The cap includes a margin which extends along the back of the user's neck, forwardly and under the ears, and then across the temples and over the forehead. Sealing structure positioned on the inside of the cap extends along the cap's margin. The sealing structure features cushion structure, exposed to contact the wearer's head and an inflatable bladder underlying the cushion structure which is positioned between the cushion structure and the cap. The sealing structure described produces a water-tight seal between the cap and the wearer's head through continuously, and in a comfortable manner, conforming to irregularities occurring in the contours of the head while the cap is worn.

The following drawings and detailed descriptions show by way of illustration, but not of limitation, a cap constructed in accordance with this invention.

DETAILED DESCRIPTION OF THE PREFERRED EMBODIMENT

Figure 1:
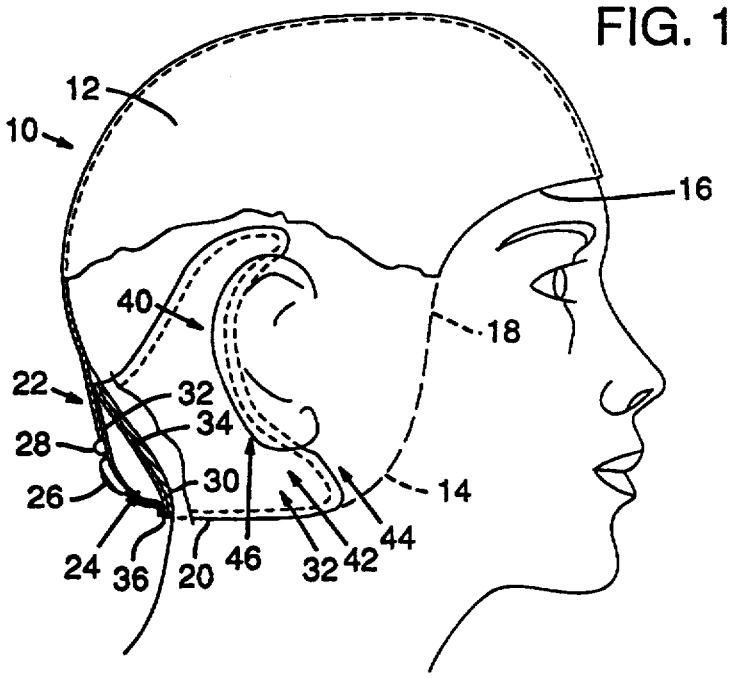
FIG. 1 is a side view, showing a cap according to the invention positioned on a wearer's head, with portions broken away to illustrate the sealing structure.
Figure 3:
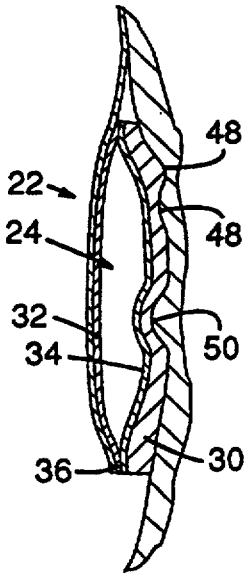
FIG. 3 is a cross sectional view, taken generally along the line 3—3 in FIG. 2 and on a slightly enlarged scale.
Figure 2:
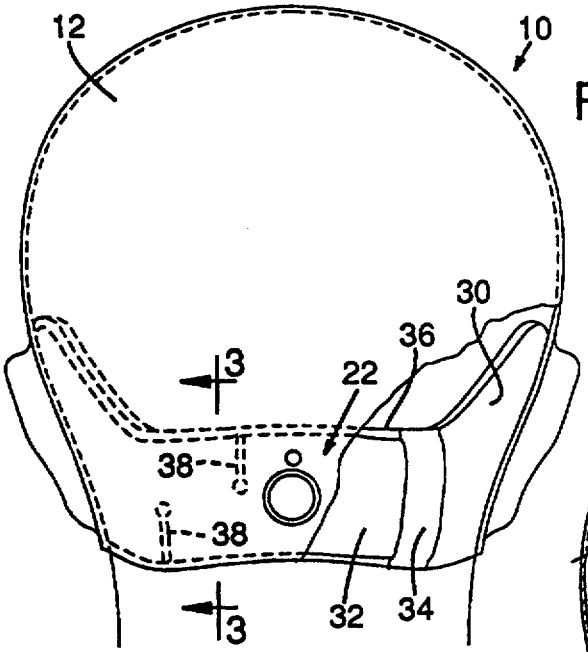
FIG. 2 is a back view, showing the cap of FIG. 1, with portions broken away to illustrate the sealing structure.

Now referring to the drawings in more detail, and more particularly, to FIGS. 1, 2 and 3, a swimming cap is shown at 10. The cap comprises a substantially hemispherical hollow cap body 12 of a relatively thin, pliant, stretchable, resilient material such as LYCRA (TM) neoprene, latex, silicon, or the like. Cap body 12 has a margin, or edge, 14, which includes a forehead region 16, a temple region 18, and a neck region 20. In use cap body 12 encloses the crown of the wearer's head, the forehead, the ears, and the upper portion of the nape of the neck. The wearer's hair is generally tucked inside cap body 12 during use so that margin 14 contacts the wearer's skin.

The cap further includes sealing structure 22, positioned on the inner surface of cap body 12, adjacent its edge or margin, 14. The sealing structure comprises an inflatable or inflated bladder, 24, equipped with a pump, 26 and a release valve, 28. Overlying the bladder and exposed on the inner side of the cap is a ribbon of foam material, 30. Preferably the foam material is relatively soft, best to enable the material to conform to the irregularities of the wearer's head.

As probably best illustrated in FIG. 3, bladder, 24, may be made of two sheet layers, as exemplified by layers 32, 34. These sheet layers may be made of any suitable plastic or elastomer material such as a polyvinyl or nitroplastic material. The margins of the sheet layers in the bladder are bonded together at edge regions of the bladder shown at 36 in FIG. 3. Bonding the edges of the layers together may be performed with an adhesive or by heat fusing the edges. If desired, and to add further strength, stitching may also be employed. The bladder is also suitably bonded to the inside of cap body 12.

If desired, partitions, such as the partitions shown at 38 in FIG. 2, may be included in the bladder structure which extend between and join layers 32, 34. The partitions serve to limit or restrain the movement of one sheet layer away from the other in the bladder structure, thus, serving to stabilize the shape of the bladder when inflated. The partitions do not extend entirely across the interior of the bladder structure, and thus do not impede the flow of air within the bladder structure.

If desired, and where the material of the cap body is non-permeable, the bladder structure may be made of one layer of material suitably bonded along its margin to the inside of the material in the cap body.

The bladder structure may be permanently inflated with a fluid medium, such as air, water or gel. However, in a preferred embodiment the bladder is inflated by the user when donning the cap, preferably by structure which is borne by the cap and thus a permanent part of the cap assembly, such as pump 26 and valve 28, earlier described. These are located at the rear of the cap in that region of the bladder structure which overlies the nape of the neck. The pump and valve have conventional construction. Suffice it to say that the pump has a button which is exposed on the outside of the cap and which is depressible as with the thumb, for the purpose of producing inflation. To release air captured within the bladder structure, the valve is actuated.

The ribbon of foam material, 30, in the form of the invention shown in FIGS. 1-3, is substantially co-extensive with the underlying bladder structure, which is to say that it overlies the bladder structure throughout its length and throughout the width of the bladder structure. The foam material in the ribbon may be manufactured of any suitable soft elastomer such as a polyvinyl or nitro material. The ribbon of material is secured to the underlying bladder structure as by bonding it in place.

In the form of the invention shown in FIGS. 1-3, the sealing structure, comprising the bladder structure and the overlying ribbon of foam material, extends on the inside of the cap and across the nape of the neck in a central expanse which has substantially uniform width. Where the cap fits over opposite sides of the head, the sealing structure terminates in enlargements, 40, on the side of the head. These enlargement facilitate a water-tight seal between the cap and the wearer's head in the region of indentation behind the wearer's ears, illustrated in FIG. 1 at 42.

Further explaining the region of indentation and the corresponding enlargement, the mandible, or jaw bone, of the head terminates at a region below the ear approximately in the region, 42, indicated at 44 in FIG. 1. The head is indented in a region extending rearwardly and upwardly from the mandible, behind the ear, and forward the mastoid process indicated at 46. In this region of indentation, enlargement 40 of the sealing structure has a width substantially greater than the sealing structure where it extends across the nape of the neck and has its forward margin approximately crescent shaped. In this way, the enlargement fits snugly against the side of the head and fills the indented regions just described.

With the bladder structure inflated and with the cap positioned on the wearer's head, the bladder structure produces a snug, somewhat yieldable fit over the nape of the neck and in the indent region which appears behind and below the ear. The foam material, which extends as an overlying strip adjacent the bladder structure, preferably is relatively soft, snugly conforming to irregularities of the head. As shown in FIG. 3, the sealing structure effectively seals small and large indents or protrusions of the human head. Cushion 30 fits snugly about the small indents or protrusions 48 of the human head, while bladder 24 conforms to the large indents or protrusions 50.

Figure 4:
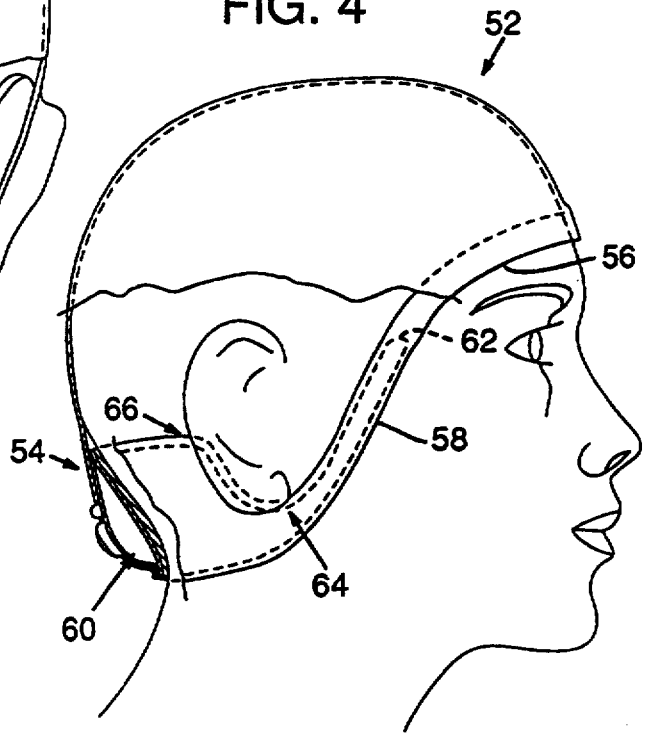
FIG. 4 is a side view of a cap representing another embodiment of the invention, positioned on a wearer's head.

FIG. 4, illustrates a modified form of the invention. In this form of the invention, the cap, 52, is provided with a sealing structure, 54, which extends across the nape of the neck and then forwardly under the ears. The sealing structure, in the modification shown in FIG. 4, continues from the ears of a wearer across the wearer's temples and then in an expanse of foam which extends over the wearer's forehead, in the region indicated at 56. The expanse which extends across the temples of the wearer is indicated at 58.

In the sealing structure shown in FIG. 4, the ribbon of foam material extends throughout the entire length and breadth of the sealing structure. The bladder structure, shown at 60 in FIG. 4, does not extend any further then approximately the wearer's temple region 58, as demonstrated by the end of the bladder structure indicated at 62 in FIG. 4.

It should also be noted that in the form of the invention shown in FIG. 4, the sealing structure does not extend upwardly and around the top of the ear as shown in FIG. 1. Thus, the sealing structure in the form of the invention shown in FIG. 4, on each side of the head, embraces an area extending from approximately the mandible region 64 to a region located approximately half way up the rear of the ear 66.

While modifications of the invention have been shown and described with particularity, obviously modifications are possible and it is intended to cover all such modifications and variations as come within the depended claims.

We claim:

1. A leak-proof cap comprising:

a cap body of pliant material having an edge, the edge extending across the nape of a wearer's neck, adjacent the wearer's ears, and across the forward part of the wearer's head; and sealing structure positioned on the inside of the cap body adjacent said edge, said sealing structure including, for each of the wearer's ears, an inflatable bladder portion positioned directly below the wearer's ear and adjacent the mandible, said portion extending upwardly along at least a part of the rear of the ear and across the mastoid process.

2. The cap of claim 1 wherein the sealing structure further includes, for each ear, cushion structure overlying the bladder portion.

3. The cap of claim 1 wherein the cap further includes a pump borne by the cap body for inflating the bladder portions.

4. The cap of claim 1 wherein the sealing structure includes an exposed layer of foam material for contacting the wearer's head, and the bladder portion for each ear is interposed between the layer of foam and the cap body.

5. The cap of claim 1 where in the sealing structure further includes a bladder portion that extends up and over the wearer's temples.

6. The cap of claim 6 wherein the sealing structure extends over the wearer's forehead.

* * * * *